US009770375B2

(12) United States Patent
Lin et al.

(10) Patent No.: US 9,770,375 B2
(45) Date of Patent: Sep. 26, 2017

(54) MULTIFUNCTIONAL MATTRESS

(71) Applicant: Liming Lin, Zhejiang (CN)

(72) Inventors: Liming Lin, Zhejiang (CN); Nu Zhang, Zhejiang (CN)

(73) Assignee: Liming Lin (CN)

( * ) Notice: Subject to any disclaimer, the term of this patent is extended or adjusted under 35 U.S.C. 154(b) by 0 days.

(21) Appl. No.: 15/122,015

(22) PCT Filed: Mar. 20, 2014

(86) PCT No.: PCT/CN2014/073763
§ 371 (c)(1),
(2) Date: Aug. 26, 2016

(87) PCT Pub. No.: WO2015/127700
PCT Pub. Date: Sep. 3, 2015

(65) Prior Publication Data

US 2017/0007475 A1 Jan. 12, 2017

(30) Foreign Application Priority Data

Feb. 27, 2014 (CN) ..... 2014 1 0068892

(51) Int. Cl.
*A61G 1/013* (2006.01)
*A61G 1/04* (2006.01)
(Continued)

(52) U.S. Cl.
CPC ..... *A61G 1/013* (2013.01); *A47C 27/081* (2013.01); *A61G 1/04* (2013.01); *A61G 1/042* (2016.11);
(Continued)

(58) Field of Classification Search
CPC ..... A61G 1/013
(Continued)

(56) References Cited

U.S. PATENT DOCUMENTS 2,614,266 A * 10/1952 Smith ..... A61G 1/003 5/116
5,018,226 A * 5/1991 Davies ..... A61G 1/00 5/710
(Continued)

FOREIGN PATENT DOCUMENTS

CN 1383801 12/2002
CN 201022811 2/2008
(Continued)

OTHER PUBLICATIONS

International Search Report dated Dec. 4, 2014 issued in corresponding International patent application No. PCT/CN2014/073763.
(Continued)

*Primary Examiner* — Fredrick Conley
(74) *Attorney, Agent, or Firm* — Ostrolenk Faber LLP

(57) ABSTRACT

A multifunctional mattress, equipped with N body support members, and provided with a left stretcher rod through-penetrating area and a right stretcher rod through-penetrating area along a direction of a long edge L respectively, the two stretcher rod through-penetrating areas are provided with a stretcher hole for penetrating a stretcher rod through, the stretcher hole is stretched along a direction parallel to the long edge L of the mattress body; the mattress body is provided with a plurality of airbag areas, strip-like gaps are arranged among the airbag areas, the strip-like gaps are arranged in parallel to each other in a direction mutually perpendicular to the long edge L of the mattress body; a width H of the strip-like gap is greater than or equal to a width h of the body support member, a thickness of the inflated airbag area is greater than that of the body support member. The multifunctional mattress is quick to operate,
(Continued)

safe and less laborious, and portable and environmentally-friendly.

9 Claims, 3 Drawing Sheets

(51) Int. Cl.
*A61G 1/048* (2006.01)
*A61G 7/057* (2006.01)
*A47C 27/08* (2006.01)

(52) U.S. Cl.
CPC ..... *A61G 1/048* (2013.01); *A61G 7/05769* (2013.01)

(58) Field of Classification Search
USPC ..... 5/625–630, 620, 110–111
See application file for complete search history.

(56) References Cited

U.S. PATENT DOCUMENTS 5,249,321 A * 10/1993 Graf ..... A61G 1/00 280/8
5,742,958 A 4/1998 Solazzo

FOREIGN PATENT DOCUMENTS

| | | |
|---|---|---|
| CN | 201996755 | 10/2011 |
| CN | 202982422 | 6/2013 |
| CN | 203841944 | 9/2014 |
| JP | 3156103 | 11/2009 |

OTHER PUBLICATIONS

Chinese Search Report dated Nov. 18, 2015 issued in corresponding Chinese application No. 2014100688929.

* cited by examiner

MULTIFUNCTIONAL MATTRESS

CROSS REFERENCE TO RELATED APPLICATIONS

The present application is a 35 U.S.C. §371 National Phase conversion of PCT/CN2014/073763, filed Mar. 20, 2014, which claims benefit of Chinese application no. 201410068892.9, filed Feb. 27, 2014, the disclosures of which are incorporated herein by reference in their entirety. The PCT International Application was published in the Chinese language.

TECHNICAL FIELD

The present invention relates to a simple mattress capable of being matched with an existing mattress for tiling use, and more particularly, to a multipurpose and multifunctional flexible mattress for both medical use and routine use.

BACKGROUND ART

A mattress is a very well-known article for use, which has different categories according to different usage occasions thereof, such as an ordinary mattress for routine use, a medical mattress for use in a hospital and the like, but the existing mattress has a single purpose and fails to meet requirements for special circumstances. For instance, a patient lying on an existing medical mattress needs to be moved frequently because of nursing services like transferring among a stretcher, a sickbed and a patient car, cleaning a bed or the like. At present, links of moving the patient to the sickbed from the stretcher, moving the patient to a cart from the sickbed, moving the patient to treatment and inspection instruments from the cart, changing the sheets or the like are fundamentally completed in a manual work, and this will touch and wound the patient again in such a process, thus aggravating pain of the patient or a state of an illness due to manual misoperation. This is not beneficial for the patient. Moreover, it is most laborious for medical workers to frequently move the patient, and various nursing workers are needed to complete the motion. Alternation infection between the nursing worker and the patient may be increased in the motion process, and unnecessary manual and economic burdens of family members of the patient are also increased in these processes. For another example, it is very difficult to move and nurse the patient lying on a bed and being unable to move freely from the existing mattress at home or in a gerocomium.

An inflated multifunctional physiotherapeutic mattress is disclosed in a China Invention Patent Application No. 02113702.1. Since a patient fails to be lifted up to leave the mattress, there is still a problem that it is extremely difficult to transfer the patient, clean a bed and implement other nursing care. In addition, the existing mattress has a complicated structure and a big volume and is cumbersome, so that it is very unnatural and inconvenient to be served as a stretcher. A nursing bed for a patient lying in a bed for a long term is disclosed in a China Utility Model Patent No. 201120053549.9. Although the patient can be turned over, a function of lifting up the patient to leave a mattress without pushing and pulling the patient may not be achieved. In addition, it also has a complicated structure and a big volume and is cumbersome, and cannot be served as a stretcher for flexible use.

In view of this, a mattress capable of conveniently, safety and less laboriously moving a patient lying in a bed is needed. In addition, with the increasing requirements for tourist safety and natural disaster resistance or the like, a portable mattress capable of both camping out in the wild and being served as a stretcher in case of an emergency is needed, while the existing mattress cannot meet the above-mentioned use requirements in the meanwhile.

SUMMARY OF THE INVENTION

The present invention aims at providing a multifunctional mattress, which has a simple and reasonable structure, is light and durable and has a low manufacturing cost. Moreover, the multifunctional mattress can be matched with the existing sickbed mattress for tilting use, which is convenient to use, safe and reliable. The multifunctional mattress can also be served as a stretcher, a mattress for camping out in the wild as well as a hammock and a rescue bed, which is quick to operate, safe and less laborious, and portable and environmentally-friendly.

In order to achieve the above object, the present invention employs the following technical solutions:

A multifunctional mattress comprises a mattress body, wherein the multifunctional mattress is further equipped with a plurality of body support members; the mattress body is provided with a left stretcher rod through-penetrating area and a right stretcher rod through-penetrating area along a direction of a long edge L respectively, the two stretcher rod through-penetrating areas are preferably located in the direction of the long edge L of the mattress body, each stretcher rod through-penetrating area is provided with a stretcher hole for penetrating a stretcher rod through respectively, the left and right stretcher holes are stretched along a direction parallel to the long edge L of the mattress body; the mattress body is provided with a plurality of airbag area, each airbag areaairbag can be either formed by a single airbag or in a strip-like structure formed by gathering multi-section connected gasbagairbags, a strip-like gap is arranged among the airbag areas for the body support member to insert, the strip-like gaps are arranged in parallel to each other in a direction mutually perpendicular to the long edge L of the mattress body; a width H of the strip-like gap is greater than a width h of the body support member, and a thickness of the inflated airbag area is greater than that of the body support member. According to the present invention, a patent can be ventilated via the cooperation between the airbag area and the gap, while the body support member, the airbag area and the strip-like gap can achieve the cooperation in various operating modes. The ambulatory patients may be easily and steadily lifted up without being pushed and pulled, so that various job demands of moving the ambulatory patients with the mattress, moving the ambulatory patients without the mattress and changing a bed sheet or the like can be quickly, safely and easily completed; moreover, the ambulatory patient will be uniformly stressed in the process of lifting up the patient, so that the patient is avoided from being touched and wounded again in various treatment links, the number of nursing workers in a hospital can further be greatly decreased, and an alternative infection between a staff and the patient can be reduced.

Each airbag area can be formed either by the single airbag or by gathering multi-section connected structure airbagbags. As a preferred mode, each airbagairbag area of the mattress body are all strip-like, these strip-like airbagairbag areas are arranged in parallel to each other in a direction mutually perpendicular to the long edge L of the mattress body, and the mattress body outside the airbag region are non-airbag baseairbagairbag. When the patient is lying on a sickbed, the airbag is aeratedairbag. The body support members can be effectively positioned by means of these strip-like, transversely-arranged airbag areas so as to ensure various body support members are in a mutually-parallel position, so that the patient is stressed in a balanced manner, and thus further reducing a situation that the patient is re-wounded during various treatment motion and nursing links.

The mattress body 1 is further provided with a plurality of aerated catheters, the aerated catheters pass through all airbag areas, and preferably, two or above aerated catheters are adopted to ensure quicker and more stable inflation and deflation, and the aerated catheters are connected with inflating nozzles to inflate and deflate for the airbag areas. When needing to transfer the ambulatory patient, ventilate for the ambulatory patient, clean and nurse or replace the bed sheet, the airbag areas can be inflate via the aerated catheters and the inflating nozzles, and the airbag Areas can be deflated to return to normal after completing the above-mentioned nursing and transfer works. In addition, an inflation quantity of the airbag Area can be further regulated and controlled via the inflating nozzle and the aerated catheters, to adapt to requirements of different patients for a thickness of the airbag in different environments.

In addition, the multifunctional mattress can be further optionally equipped with two left and right stretcher rods and a plurality of body support members, these stretcher rods are plugged with the multifunctional mattress in a detachable manner, each stretcher rod is provided with at least a plurality of plugging holes for plugging the body support members in; and the plugging holes in the two left and right stretcher rods are symmetrically distributed. For instance, the multifunctional mattress is left with a space for the N body support members, and then each stretcher rod is provided with at least N plugging holes for plugging the body support members in. The N of the present patent denotes multiple, i.e., the N is a natural number of greater than 1.

Further, each stretcher rod through-penetrating area of the multifunctional mattress comprises a plurality of plugging operation spaces for the stretcher rod up and down passing through the through-penetrating area and a plurality of sub stretcher rod through-penetrating areas, each plugging operation space penetrates through the stretcher hole in the stretcher rod through-penetrating area, the plugging operation space in the left stretcher rod through-penetrating area and the plugging operation space in the right stretcher rod through-penetrating area are symmetrically distributed. These plugging operation spaces located in the stretcher rod through-penetrating area is reserved for lifting up and down the human body, so that it can be convenient to lift up or move the patient along with the bed sheet and the mattress manually or via a lifter, and can be flexibly applicable to various operating modes of listing up and down and moving the human body. Moreover, the mattress body is a foldable structure.

Further, the stretching direction of the strip-like gaps are all pointed to the plugging operation space of the stretcher rod through-penetrating area. The same plugging operation space can correspond to various strip-like gaps. More preferably, the strip-like gap corresponds to the plugging operation space, a position of the plugging operation space of the stretcher through-penetrating area corresponds to the position of part or all of the plugging holes of the stretcher rod, so that part or all of the plugging holes of the stretcher rod are exposed for plugging the body support members in.

The body support member is optimized as an accessory of the multifunctional mattress made of an elastic material, both ends of the body support member are equipped with a safety buckle, and the safety claspcan be plugged in the plugging holes of the stretcher rod to for a detachable buckling assembly, thus being matched with the stretcher rod to complete the stable support for the patient.

In addition, each stretcher rod can be 1 rod member, or preferably a stretcher rod formed by connecting and assembling two or more rod members, that is, each stretcher rod can be formed by connecting two or more sub-rod members, and the two or more rod members are fixedly connected into one stretcher rod via a detachable connecting structure. More preferably, the detachable connecting structure of the stretcher rod is an axle hole plugging-connecting structure and/or a screwed connecting structure.

The multifunctional mattress is placed on the sickbed mattress, the mattress body between the stretcher rod through-penetrating areas on both sides is a mattress bearing area, a size (width and length) of the mattress bearing area is basically consistent with a size (width and length) of the sickbed mattress below the multifunctional mattress, and the stretcher rod through-penetrating area is stretched out of the sickbed mattress. But the more preferable exemplary embodiments, the two left and right stretcher rod through-penetrating areas are located in the two long edges L of the mattress body respectively, and the size of the multifunctional mattress containing the stretcher rod through-penetrating areas is equal to the size of the sickbed mattress. For instance, a distance between the outermost edges of the two stretcher rod through-penetrating areas is basically consistent with the width of the sickbed mattress below the multifunctional mattress.

By adopting the above-mentioned technical solution, the multifunctional mattress of the present invention is easy to be matched with mattresses used in existing hospitals and gerocomiums and at home, so as to achieve an effect capable of easily and steadily lifting up and moving a bed patient to leave the mattress without pushing and pulling. The multifunctional mattress has various working modes, so that it is very convenient, safe and easy to move the bed patient to the other treatment and inspection instruments or replace the bed sheet and increase air circulation of back of bedridden patients and other nursing care. In this way, the bed patients are avoided from being touched and wounded again during various treatment, the number of care workers in a hospital can further be greatly reduced, the alternative inflection between the care worker and the patient can be reduced, and unnecessary manual and economic burdens of family members of the patient are reduced in these processes. In the meanwhile, the multifunctional mattress of the present invention can also be served as a stretcher, a mattress or a hammock for camping out in the wild. It is convenient to carry and less laborious and convenient to use.

BRIEF DESCRIPTION OF THE DRAWINGS

The embodiments as illustrated in the present invention as non-confined examples in the accompanying drawings are described in details hereinafter. Taking a cuboid mattress as an example, the other advantages and features of the multifunctional mattress of the present invention are more clear and easier to understand. Wherein:

FIG. 4 is a side view schematic diagram of a multifunctional mattress body of the present invention in a tilting state without inflating and penetrating the stretcher rod through FIG. 5 is a side view schematic diagram of a multifunctional mattress body 1 of the present invention in a state without inflating but penetrating the stretcher rod through.

DETAILED DESCRIPTION OF THE PREFERRED EMBODIMENTS

The detailed description of the preferred embodiments of the present invention is further described with reference to the embodiments given in FIG. 1 to FIG. 9 hereinafter. A multifunctional mattress of the present invention is not limited to the description of the following embodiments.

Figure 1:
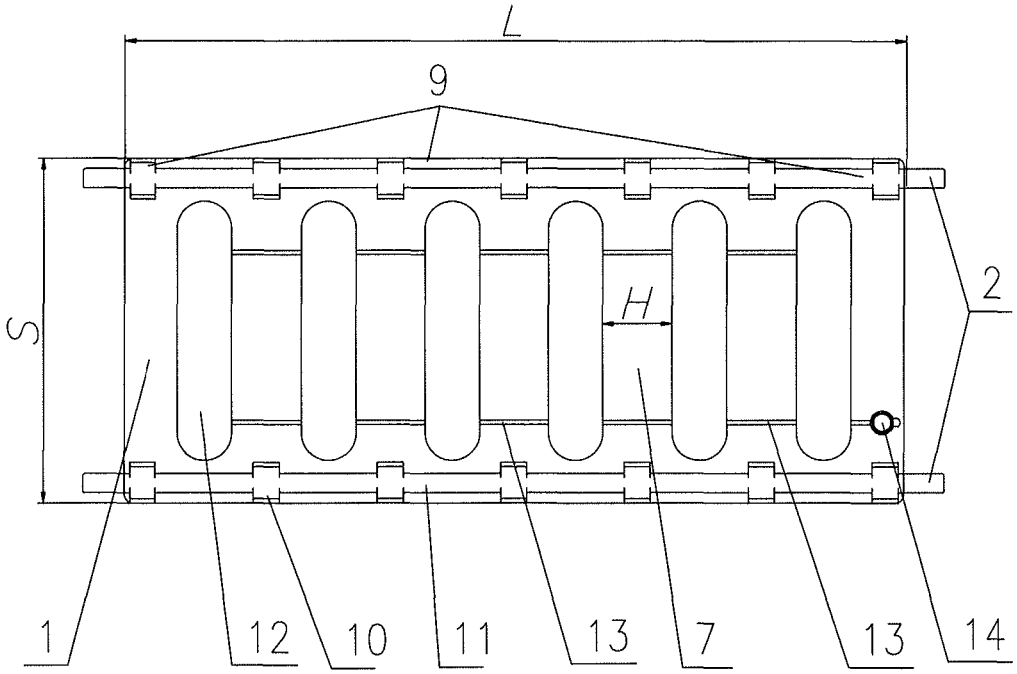
FIG. 1 is a top view schematic diagram of a first embodiment of a multifunctional mattress of the present invention.
Figure 2:
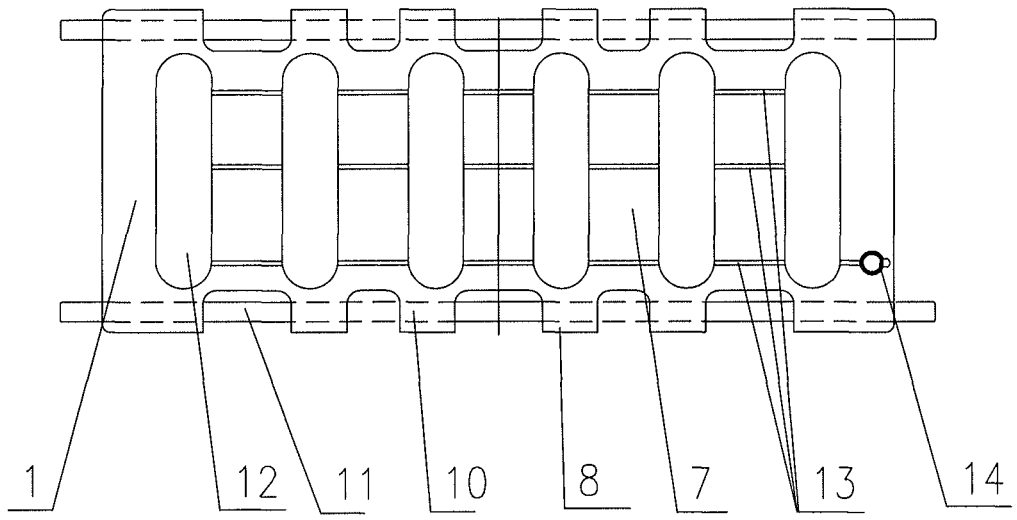
FIG. 2 is a top view schematic diagram of a second embodiment of a multifunctional mattress of the present invention.
Figure 3:
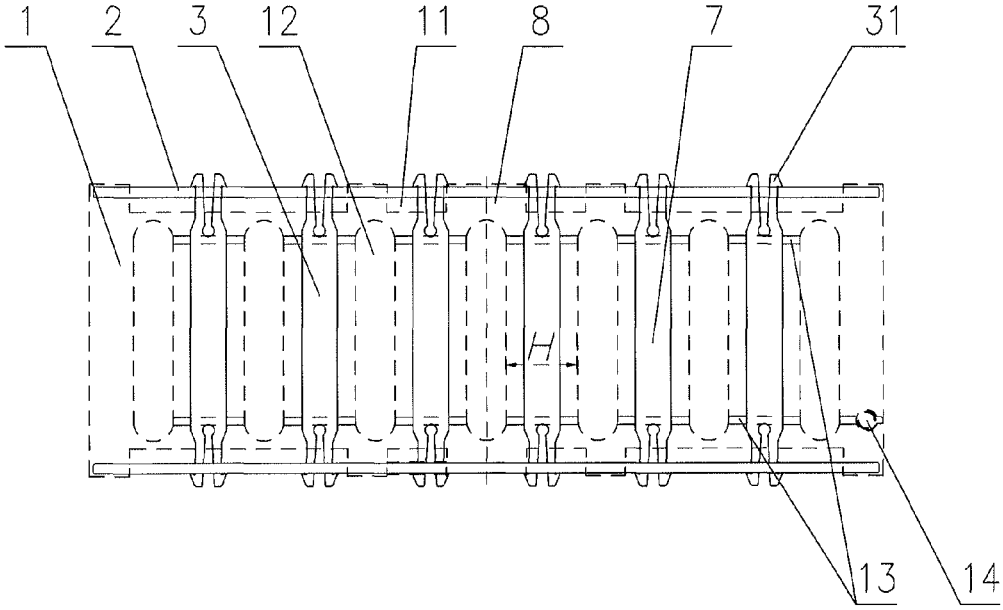
FIG. 3 is a top view plane schematic diagram when an optional accessory stretcher rod is buckled with a body support member of a multifunctional mattress of the present invention.

Referring to FIG. 1, FIG. 2 and FIG. 3, a multifunctional mattress of the present invention comprises a mattress body 1 and optional accessories of two stretcher rods 2 and a plurality of body support members 3. As illustrated in FIG. 1, the multifunctional mattress is a cubiod having a length L, a width S and a thickness d, and a size of the length L and the width S is adjacent to a size of an ordinary standard sickbed mattress. In practice, if the stretcher through-penetrating area of the multifunctional mattress is stretched out of the sickbed mattress, a problem will be created while sending the multifunctional mattress along with a patient into an inspection instrument. Two edges of the mattress body 1 are provided with a stretcher rod through-penetrating area 9 along a direction of the length L thereof, i.e., a direction of a long edge L respectively, each stretcher rod through-penetrating area 9 is opened with a stretcher hole 10 admitting the left stretcher rod or the right stretcher rod 2 to plug in, preferably two stretcher holes 10 are arranged at a left side edge and a right side edge of the mattress body 1, and stretched along a direction of the length L respectively, that is two stretcher holes 10 are arranged in a left side long edge L and a right side long edge L for penetrating through the stretcher rods from two-side. The mattress body 1 is made of various materials with a certain strength and flexibility. As illustrated in FIG. 1, the mattress body 1 may comprises a airbagnon-airbag substrate, the non-airbag substrate is provided with a plurality of airbag areas 12, and each airbag area 12 is formed using a strip-like airbagbag. In addition, the multifunctional mattress can further comprises two aerated catheters 13 and inflating nozzles 14 passing through various airbag areas 12, the inflating nozzle 14 is connected with various aerated catheters 13, and various aerated catheters 13 and various airbagbags 12 can be conveniently inflated or deflated via the inflating nozzle 14. Various airbag areas 12 are arranged in parallel to each other along a direction of the width S of the mattress body 1 in a direction perpendicular to the long edge L of the mattress body 1, a strip-like gap H is formed between every two adjacent airbag area 12, the strip-like gap H between every two adjacent airbag area 12 is a solid substrate portion of the mattress body 1 in fact, and the gap H of the solid portion is naturally stretched along a direction of the width S of the mattress body 1.

The stretcher rod 2 is served as an optional accessory of the multifunctional mattress, a plurality of plugging holes 21 plugging the body support members 3 are preferably arranged in the left and right stretcher rods 2, the plugging holes of the left and right stretcher rods 2 are symmetrically distributed. As illustrated in FIG. 3, when the number of the body support members is 6, the number of the plugging holes in each stretcher rod 2 is at least 6, and a user can select a plugging position of the body support member adapting to a bed patient according to needs.

As illustrated in FIG. 3, each stretcher through-penetrating area 9 can be a continuous stretcher cascading area, but more preferably, each stretcher rod through-penetrating area 9 is formed by a plurality of discontinuous sub-stretcher rod through-penetrating areas 8, and a plugging operation space 11 penetrating through the stretcher rod through-penetrating area 9 up and down is arranged between two sub-stretcher rod through-penetrating areas 8.

In an embodiment of FIG. 3, the plugging operation space 11 in the left side stretcher rod through-penetrating area 9 and the plugging operation space 11 in the right side stretcher rod through-penetrating area 9 are symmetrically distributed. Another exemplary embodiment is as illustrated in FIG. 2, a strip-like gap 7 corresponds to the plugging operation space 11, and a stretching direction of the strip-like gap 7 points to the plugging operation space 11 of the stretcher rod through-penetrating area 9. A more preferred solution is that, a position of the plugging operation space 11 of the stretcher rod through-penetrating area 9 corresponds to a position of part or all of the plugging holes 21 of the stretcher rod 2, so that part or all of the plugging holes 21 of the stretcher rod 2 are exposed for a safety clasp to buckle.

In an embodiment as illustrated in FIG. 3, the multifunctional mattress is equipped with 6 body support members 3, and two stretcher rod through-penetrating areas 9 are symmetrically distributed left and right. Each stretcher rod through-penetrating area 9 is divided into 6 sections of sub-stretcher rod through-penetrating areas 8 via 5 plugging operation spaces 11, the strip-like gap 7 between the airbag area 12 points to the corresponding plugging operation space 11, so as to ensure the body support member 3 may be transversely plugged in parallel, playing a role of supporting in a balanced manner and fixing. In addition, as illustrated in FIG. 2 and FIG. 3, the mattress body is further provided with a folded line, so that the mattress has a foldable function to conveniently carry and take in.

Differences among FIG. 1, FIG. 2 and FIG. 3 are that: the stretcher through-penetrating area in FIG. 1 is a discontinuous cylinder-like structure formed by folding the edge of the mattress, and FIG. 2 and FIG. 3 represent the plugging operation space of the mattress body 1 penetrates through the stretcher rod through-penetrating areas up and down. The two types of exemplary embodiments are basically the same in an aspect of function, and a key point is that a change in different structures during manufacturing. FIG. 3 represents a state while using the multifunctional mattress of the present invention, and is a top view plane schematic diagram of a state of only moving a patient body but not moving a bed sheet and a mattress while cleaning the bed and the bed sheet and during other serves.

Figure 4:
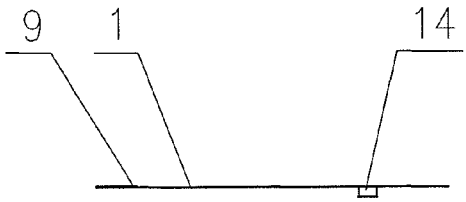
Figure 5:
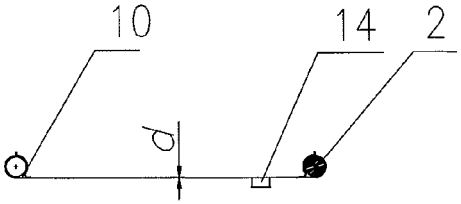

FIG. 4 and FIG. 5 are side views of a mattress, wherein a mattress body 1 in FIG. 4 is in an ordinary state of tilting for rest, and the airbag area 12 is not inflated. FIG. 5 is a side view schematic diagram that the mattress body 1 is in a state without inflating but penetrating through the stretcher rod 2, while two stretcher rods 2 are detachably plugged into the stretcher holes 10 in the mattress body 1 respectively. The thickness of the mattress body 1 is equal to the thickness d of the solid substrate portion of the mattress body 1 while the airbag area 12 is in a state without inflating, and is generally suitable for any occasion of moving the patient along with the mattress body 1 and the bed sheet together for treatment.

Figure 6:
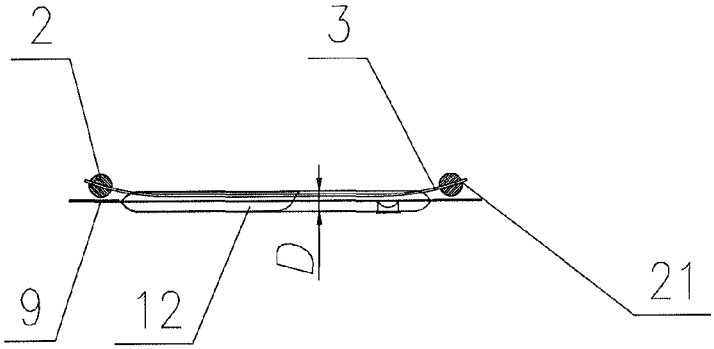
FIG. 6 is a side view schematic diagram of an embodiment in FIG. 3 of the present invention in an inflation state, and under such state, a patient can be lifted up and down or moved without a bed sheet and a mattress.
Figure 7:
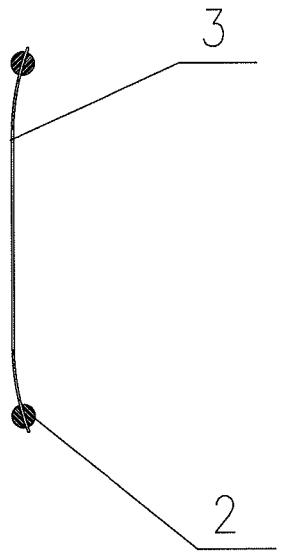
FIG. 7 is a side view schematic diagram of specifically buckling multifunctional mattress accessories of stretcher rods and body support members of the present invention.

In FIG. 6, the mattress body 1 is in an inflation state, wherein the body support member 3 is plugged in the gap H between the airbag area 12 of the mattress body 1, the body support member is preferably a safety clasp, and the two stretcher rods 12 and the safety clasp 31 of the safety clasp belt 3 form a detachable buckling assembly in a buckling assembly manner. When the multifunctional mattress is inflated, the airbag area 12 is inflated, a strip-like gap 7 is formed among various airbag areas 12, while the non-airbag substrate of the mattress body 1 is not inflated, and the thickness D of the inflated airbag 12 is far greater than the thickness d of the non-airbag substrate of the mattress body 1, thereupon the patient is supported upward via an air action of the strip-like airbag 12, a flexible groove-like strip-like gap H is formed between every two adjacent airbags 12, so that a flexible interspace is inevitably formed between the body lying on the mattress body 1 and the groove-like strip-like gap H. wherein, the width size of the strip-like gap H is greater than the width size h of various body support member 3, the thickness of the body support member 3 is far less than the thickness D of the airbag area 12, so that the body support member 3 can smoothly pass through between the patient body and the flexible strip-like gap H.

The body support member 3 can have various exemplary embodiments, for instance, the body support member 3 is an accessory of the multifunctional mattress made of an elastic material. A more preferred solution is that both ends of the body support member 3 are provided with a safety clasp 31, the safety clasp 31 can be plugged in the plugging holes 21 in the stretcher rod 2 to form a detachable buckling assembly, so as to match with the stretcher rod to steadily support the patient.

Figure 8:
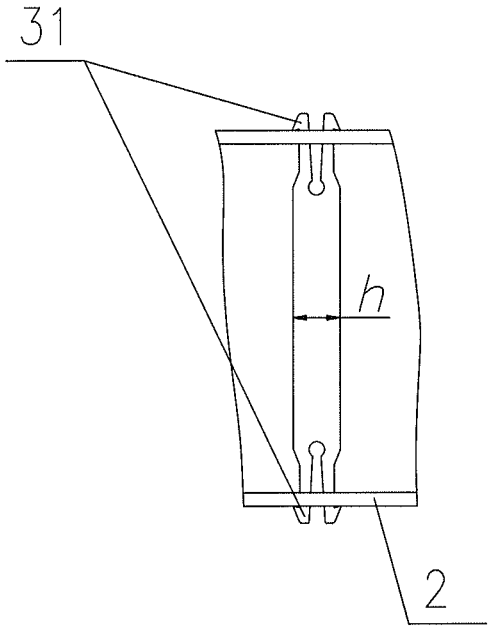
FIG. 8 is a top view schematic diagram of specifically buckling multifunctional mattress accessories of stretcher rods and body support members of the present invention.
Figure 9:
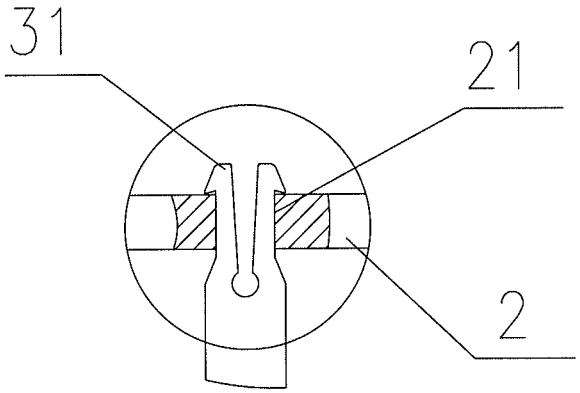
FIG. 9 is a partial enlarged drawing of buckling a body support member and a lever in an embodiment of FIG. 8.

For instance, in FIG. 8 and FIG. 9, the body support body 3 is a safety clasp belt, the safety clasps 31 at both ends of each safety clasp belt are penetrated through the plugging holes 21 in the two stretcher rods 2, to firmly lock under a clamping fit.

The safety clasp 31 described in the present invention can also employ various exemplary embodiments, such as, a buckle in a T-shaped structure, or a buckle in a latch structure. A specific safety clasp in a latch clamping structure is as illustrated in FIG. 8, the safety clasp 31 is a structure composed of two hook-like teeth, and there is a certain distance between two hook-like teeth. These safety clasps 31 is detachably buckled in the plugging hole 21 of the stretcher rod or other devices and automatically engaged for locking, and moreover, the safety clasp in the T-shaped structure or the safety clasp in the latch buckling structure is rotated to apply a pressure to unlock and pull out when needing to open. The connection between the safety clasp of the body support member and the stretcher rod is not limited to the structure as mentioned above, and can also be any locking and buckling mode capable of being conveniently locked and unlocked, which are not listed one by one herein.

In order to conveniently and fast use the mattress, the size of the mattress is matched with the size of a common sickbed having a standard margin. For instance, the multifunctional mattress in FIG. 1 to FIG. 3 are placed on the common sickbed mattress, the left and right stretcher rod through-penetrating areas 9 are located on two long edges L of the mattress body 1 respectively, the width S of the multifunctional mattress is equal to the size of the sickbed mattress, and the width of the multifunctional mattress comprises the width of the stretcher rod through-penetrating area.

Under exceptional circumstances as required by a critical patient, the mattress in a state as illustrated in FIG. 1 is placed below an ordinary bed sheet as a standby accessory. When needing to move the bed patient to other occasions to treat and inject or replace the bed sheet, the patient lying in bed can be less vibrated in various processes of moving to the sickbed from the stretcher, moving to the cart from the sickbed, moving to the treatment and inspection instruments from the cart and replacing the bed sheet or the like in the motion process of medical treatment, recovery and nursing, and is avoided from increasing the pain and worsening the condition in these processes according to a method matched with other accessories for use as mentioned above, so that high-quality management and people-oriented service for the bed patient during medical treatment are improved.

Each stretcher rod 2 can be 1 rod member, but to add a portable function of the multifunctional mattress, two or more rod members are connected to form one stretcher rod except for reducing a volume and a weight of the multifunctional mattress as much as possible. The rod member of the stretcher rod 2 may be two or more sections subject to coarse screwed connection, which are plugged in through the two ends of the mattress and then subject to screwed connection. These rod members are in detachably fixed connection, and connecting structures thereof can adopt various solutions. The preferred solution is that: the detachably connecting structure is an axle plugging-connecting structure and/or a screwed connecting structure. Both the axle hole plugging-connecting structure and the screwed connecting structure are a fixed connecting structure that is convenient to assemble and disassemble, has good connecting intensity and high connecting reliability.

There may be a great diversity of operating modes of the multifunctional mattress of the present invention, and an operating principle of the multifunctional mattress of the present invention is further described through various specific use examples hereinafter.

Operating mode 1: an operating mode of moving a bed patient with a mattress and a bed sheet together: for a treatment occasion of moving a bed patient with a mattress 1 and a bed sheet, the stretcher rods 2 need to be penetrated through merely, the bed patient is steadily lifted up without touching by uniformly applying an upward applied force to the left and right stretcher rods 2, then the sick and wounded are easily and safely moved to a cart, and to treatment and inspection instruments from the cart.

Operating mode 2: an operating mode of moving a bed patient without a mattress and a bed sheet for treatment or replacing a bed sheet: when a bed patient fails to be treated with a bed sheet and a mattress or needs to move or replace the bed sheet, the airbag of the airbag area 12 is inflated through the aerated catheter 13 to lift up a bed patient as long as the mattress 1 is inflated, the bed sheet is recessed via the strip-like gap 7 between the airbag areas to pass the body support members 3 through the groove-like gap formed by the recessed bed sheet and the human body. The body support members 3 are plugged in the plugging holes 21 of the left and right stretcher rods 2, the body support members 3 play a role of supporting the human body by uniformly applying an upward acting force to the left and right stretcher rods 2, the bed patient is naturally lifted up to leave the mattress body 1 and the bed sheet, so as to be able to conveniently, safely and less laboriously lift the patient up, move to other treatment and inspection instruments or replacing the bed sheet under a circumstance without turning the patient body over.

Operating mode 3: an operating mode as a stretcher: the left and right stretcher rods 2 are plugged in the stretcher holes 10 of the mattress body 1 to form a stretcher, the stretcher carrying the sick and wounded can be directly placed on a common sickbed, then the left and right stretcher rods 2 are extracted, the mattress 1 is inflated, the body support members 3 are inserted, the safety clasp 31 is plugged into the plugging holes of the left and right stretcher rods 2 respectively, then the upward acting force is uniformly applied to the left and right stretcher rods 2, the bed patient is lifted up, put in the bed sheet and then lifted down, then the mattress is deflated, and the mattress body 1 becomes an ordinary mattress for rest and waiting for a command.

Operating mode 4: an operating mode to ventilate for a patient lie in bed: the airbag area 12 is inflated, the bed patient is lifted up through the airbag, and the strip-like gap 7 between the airbag areas 12 can be used for ventilating for the back of the patient.

Operating mode 5: an operating mode as a mattress for taking up quarters: the mattress body 1 is spread on a ground, a platform or other lying plane, the airbag 12 is inflated, and the mattress body 1 is spread with bedding article on the bed, and the airbag area 12 becomes a mattress that can avoid moisture and keep warm. Particularly, the mattress can be served as a temporary sickbed when sickbeds for disaster relief are scarce.

Operating mode 6: an operating mode as a hammock: a mattress is reliably connected with a firm support through the stretcher hole in the mattress body 1 or penetrating the stretcher rods 2 through.

A recommended embodiment of the present invention has been illustrated and described, and more particularly, the multifunctional mattress body is not limited to be matched with the above-mentioned accessories of body support members and stretcher rods for use, and more advantageously: the multifunctional mattress body is matched with a plurality of dedicated equipment capable of stretching into the above-mentioned strip-like gaps and lifting up and down and moving the patient in a balanced manner. All equivalent technological changes and modifications made according to the claims of the present invention shall all be deemed to fall within the scope of the present invention.

The invention claimed is:

1. A multifunctional mattress, comprising a mattress body wherein: said multifunctional mattress is further equipped with N body support members; the mattress body is provided with a left stretcher rod through-penetrating area and a right stretcher rod through-penetrating area along a direction of a long edge respectively, each stretcher rod through-penetrating area is provided with a stretcher hole penetrating a stretcher rod respectively, and the left and right stretcher holes are both stretched along a direction parallel to the long edge L of the mattress body; the mattress body is provided with a plurality of airbag area, strip gaps are arranged among the airbag areas, the strip gaps are arranged in parallel to each other in a direction mutually perpendicular to the long edge L of the mattress body; and a width H of said strip gap is greater than a width h of the body support member, and a thickness of the inflated airbag area is greater than that of the body support member.

2. The multifunctional mattress according to claim 1, wherein: various airbag areas of the mattress body are all strips, these strip airbag areas are arranged in parallel to each other in a direction mutually perpendicular to the long edge L of the mattress body, and the mattress body excluding the airbag area is a non-airbag substrate.

3. The multifunctional mattress according to claim 1, wherein:

the mattress body is further provided with at least two aerated catheters, the aerated catheters pass through all airbag areas, and the aerated catheters are connected with an inflating nozzle to inflate and deflate the airbag area.

4. The multifunctional mattress according to claim 1, wherein:

the multifunctional mattress is further equipped with a left stretcher rod and a right stretcher rod, each stretcher rod is provided with at least N plugging holes for the body support members to plug in; and the plugging hole of the left stretcher rod and the plugging hole of the right stretcher rod are symmetrically distributed.

5. The multifunctional mattress according to claim 4, wherein:

each stretcher rod through-penetrating area of the multifunctional mattress comprises a plurality of plugging operation spaces penetrating through the stretcher rod through-penetrating area up and down and a plurality of sub-stretcher rod through-penetrating area, each plugging operation space penetrates through the stretcher hole of the stretcher rod through-penetrating area, the plugging operation space in the left stretcher rod through-penetrating area and the plugging operation space in the right stretcher rod through-penetrating area are symmetrically distributed.

6. The multifunctional mattress according to claim 4, wherein:

both ends of the body support member are provided with a safety clasp, and the safety clasps of the body support member are plugged in the plugging holes in the stretcher rods to form a detachable buckling assembly.

7. The multifunctional mattress according to claim 4, wherein:

said each stretcher rod comprises two or more sub-rod pieces, and the two or more sub-rod pieces are fixedly connected into one stretcher rod via a detachable connecting structure.

8. The multifunctional mattress according to claim 1, wherein:

the multifunctional mattress is placed on a sickbed mattress, the left and right stretcher rod through-penetrating areas are located on two long edges L of the mattress body respectively, and a size of the multifunctional mattress containing the stretcher rod through-penetrating area is equal to that of the sickbed mattress.

9. The multifunctional mattress according to claim 1, wherein the mattress body is a foldable structure.

* * * * *